United States Patent [19]

Yamamoto

[11] Patent Number: 4,621,815

[45] Date of Patent: Nov. 11, 1986

[54] REEL ASSEMBLY FOR SLOT MACHINES

[75] Inventor: Toshio Yamamoto, Tokyo, Japan

[73] Assignee: Kabushiki Kaisha Universal, Tochigi, Japan

[21] Appl. No.: 670,997

[22] Filed: Nov. 13, 1984

[30] Foreign Application Priority Data

Nov. 14, 1983 [JP] Japan ..... 58-174764[U]

[51] Int. Cl.[4] ..... A63F 5/04

[52] U.S. Cl. ..... 273/143 R

[58] Field of Search ..... 273/143; 40/502–506, 40/480; 235/1 C

[56] References Cited

U.S. PATENT DOCUMENTS

| | | | |
|---|---|---|---|
| 462,283 | 11/1891 | Strobel et al. | 273/143 R X |
| 1,763,841 | 6/1930 | Watling | 273/143 R |
| 2,153,588 | 4/1939 | Peters | 273/143 R |
| 3,281,149 | 10/1966 | Miller | 273/143 R |
| 3,733,075 | 5/1973 | Hooker et al. | 273/143 R X |
| 4,051,939 | 10/1977 | Murphy et al. | 273/143 X |
| 4,410,178 | 10/1983 | Partridge . | |

FOREIGN PATENT DOCUMENTS

| | | | |
|---|---|---|---|
| 2092795 | 8/1982 | Fed. Rep. of Germany | 273/143 R |
| 2823379 | 3/1979 | United Kingdom | 273/143 R |

*Primary Examiner*—Paul E. Shapiro

*Attorney, Agent, or Firm*—Young & Thompson

[57] ABSTRACT

A slot machine reel comprises a cylindrical body having symbols on the periphery thereof and a reinforcing plate fixed to the cylindrical body and coupled therethrough to a drive shaft of a motor. The cylindrical body has a bridge fixed thereto and including arms formed to extend toward the central portion of the body, and the reinforcing plate is fixed to the bridge. The cylindrical body and bridge are preferably plastic moldings so as to make the reel light in weight, and the reinforcing plate is preferably a metal plate such as aluminum so as to obtain a firm coupling to the drive shaft of a motor. The cylindrical body is comprised by two short cylindrical frames having tongues that extend toward each other and to which a belt-type sheet bearing printed symbols is secured. The surfaces of the tongues to which the sheet is secured are set radially inwardly the thickness of the sheet, so that the peripheries of the frames and the sheet are flush with each other.

10 Claims, 2 Drawing Figures

REEL ASSEMBLY FOR SLOT MACHINES

BACKGROUND OF THE INVENTION

The present invention relates to a reel for use with a slot machine, and more particularly, it relates to a reel structure suitable for a slot machine whose reel is driven by an electric motor.

In general, a slot machine is provided with a plurality of reels each of which has symbols disposed on its outer periphery. On starting a game, these reels are simultaneously rotated, and when the reels are stopped, whether there is a win or not is detected in accordance with a combination of symbols positioned on a winning line.

In conventional slot machines, the reels have been driven by a force generated by a pulling action of a start lever. However, more recently, these reels have been driven by an electric motor. Among these latter types of slot machines, if a stepping motor is used, the detection of the stopped position of the rotating reels, that is, the discrimination of symbols stopped on the winning line, is determined by the number of drive pulses supplied to the stepping motor. This arrangement is very convenient because the detection of a win is carried out with ease.

Stepping motors have in general a low torque, so that if the reels for a slot machine are driven by such a stepping motor, a difficulty arises because of its response characteristics, particularly at the time of starting the machine. In other words, conventional reels are not sufficiently light in weight, and have a large inertial mass. Therefore, it takes a fairly long time for a reel to reach a constant speed of rotation.

In order to solve this problem, it is possible to make the reel thinner, or to use a skeleton frame structure for the reel. However, when lighter weight of the reel is achieved in this way, it tends to jeopardize the strength thereof. Slot machines are often used quite repetitively, so that the rotation and stopping of the reel occur quite frequently. As a result, if the strength particularly at the connection between the reel and a drive shaft of the electric motor becomes insufficient due to the pursuit of lighter weight, undesirable play occurs at this connection or an eccentric rotation of the reel results, and so the durability of the reel decreases.

OBJECTS OF THE INVENTION

It is therefore a principal object of the present invention to provide a lighter weight slot machine reel.

It is a further object of the present invention to provide a slot machine reel which can be mounted firmly on a motor drive shaft and which has sufficient durability for repetitive use.

It is another object of the present invention to provide a slot machine reel having superior response characteristics of rotation at the time of starting, even if the reel is coupled to an electric motor with a low torque such as a stepping motor.

It is a still further object of the present invention to provide a slot machine reel which can be readily manufactured and assembled at low cost.

SUMMARY OF THE INVENTION

The above objects of the present invention can be attained by providing a cylindrical body formed of lightweight material on the periphery of which symbols are disposed, and by coupling the cylindrical body to the drive shaft of an electric motor through a reinforcing plate having sufficient strength.

In a preferred embodiment according to the present invention, the cylindrical body is a plastic molding so as to make it light in weight, and the reinforcing plate is an aluminum die casting. In addition, the securement of the reinforcing plate to the cylindrical body is achieved by utilizing a bridge member including arms extending from the periphery of the cylindrical body to its center portion.

BRIEF DESCRIPTION OF THE DRAWINGS

The invention will now be described by way of example only, with reference to the accompanying drawings, wherein.

DETAILED DESCRIPTION OF THE INVENTION

Figure 1:
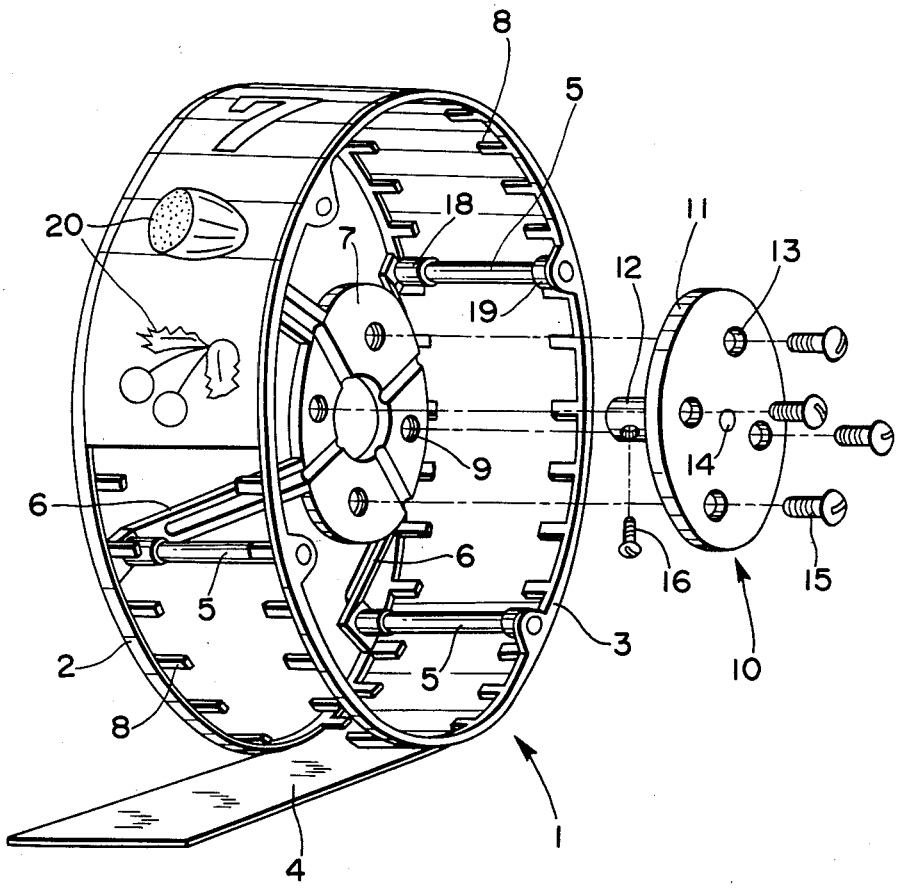
FIG. 1 is a partially exploded perspective view of an embodiment of a reel assembly for slot machines according to the present invention.
Figure 2:
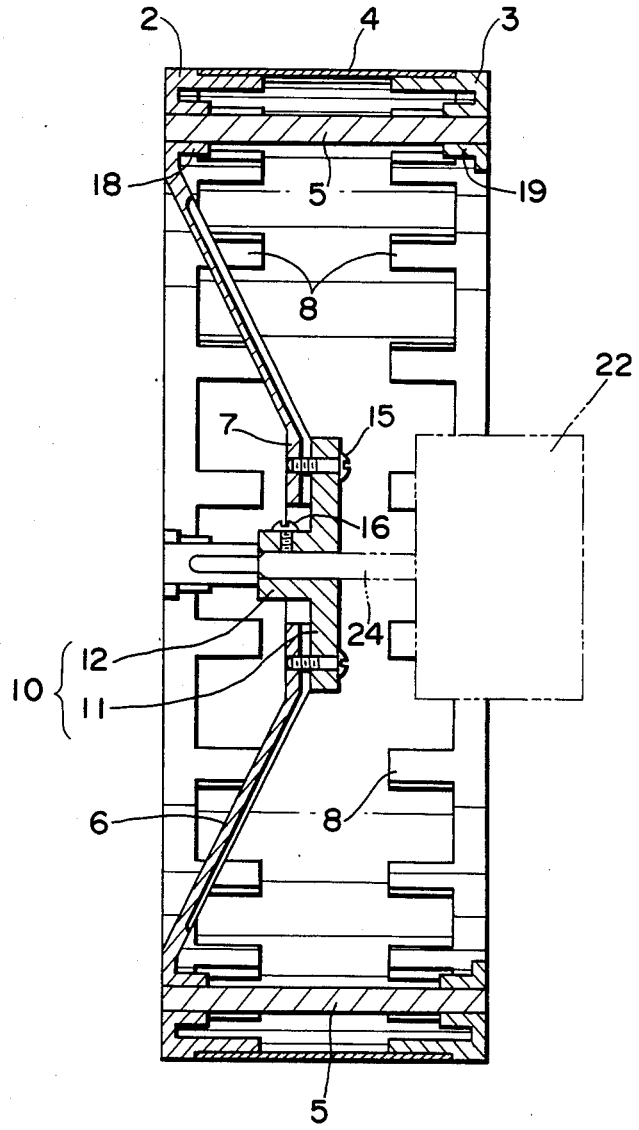
FIG. 2 is an axial cross section thereof.

As particularly shown in FIGS. 1 and 2, a reel body 1 comprises frames 2 and 3 comprised each by a short cylindrical frame, and a sheet 4 on which symbols 20 have been provided by means of, for example, printing. The assembly of the frames 2 and 3 is accomplished by inserting opposite ends of connecting rods 5 into sleeves 18 and 19 formed integrally with the frames. The frames 2 and 3 may be made of plastic or other synthetic resin. In this case, the connecting bar 5 may be integrally molded with one of the frames 2 and 3.

The frame 2 is secured to or integrally molded with a suitably selected number of bridge arms 6 extending toward the central portion of the cylindrical body and connected to a bridge plate 7 at its central portion. The number of bridge arms 6 is chosen so as to achieve light weight of the reel body as well as a suitable strength thereof. Preferably, the arms 6 are arranged in a radial manner from the bridge plate 7 and symmetrically about the axis of the reel, in order to maintain the rotary balance of the reel body 1.

The frames 2 and 3 are each provided with axially inwardly extending tongues 8 for supporting the sheet 4 along the periphery of the short cylindrical frames 2 and 3. It is to be noted that the tongues 8 are spaced from each other in order to make the reel body 1 light in weight and have radially outer surfaces that are spaced radially inwardly from the radially outer surfaces of their respective frames 2 and 3 a distance equal to the thickness of the sheet 4, as best seen in FIG. 2, so that the radially outer surfaces of frames 2 and 3 and sheet 4 are flush with each other. Tongues 8 are secured to sheet 4 by cementing or the like. The bridge plate 7 is formed with screw holes 9 for securing thereto a reinforcing plate 10 as will be described later.

The reinforcing plate 10 comprises a mounting plate 11 and a tubular portion 12 integrally mounted on the mounting plate 11. The mounting plate 11 is provided with machine screw holes 13 at the positions corresponding to the screw holes 9 on the bridge plate 7. Preferably, the reinforcing plate 10 is of a metal such as an aluminum die casting. However, rigid synthetic resins may be employed as far as they satisfy the strength requirements. The reinforcing plate 10 is formed with a through hole 14 at the center thereof, the through hole 14 passing through the mounting plate 11 and forming a continuation of the interior of the tubular portion 12 as best seen in FIG. 2.

The reel body 1 and reinforcing plate 10 are interconnected with machine screws 15. A drive shaft 24 of a stepping motor 22 for rotation of the reel body 1 is inserted into the through hole 14. By tightly screwing a set screw 16 through the side wall of the tubular portion 12, the drive shaft 24 of the motor is integrally coupled with the reinforcing plate 10.

Although, according to the embodiment shown in the drawings, the reel body 1 comprises frames 2 and 3 and sheet 4, nevertheless, it is not limited to this frame structure as long as lightness in weight can be achieved. For example, the frames 2 and 3 and the sheet 4 may be formed as an integral short cylinder and thereafter the bridge component can be mounted thereon. Also, the reinforcing plate 10 may be secured to the reel body 1 by means of bolts and nuts, caulking or the like, or the reinforcing plate 10 may be molded so as to be embedded in the bridge plate 7.

As seen from the above description, since the lightweight reel body 1 is coupled through the reinforcing plate 10 with sufficient strength to the drive shaft 24, it is possible to ensure a reliable starting of the reel, and is possible to improve the strength at the connection between the drive shaft of the motor and the reel, thus eliminating the problem of durability.

Having described the invention with reference to the embodiment shown in the accompanying drawings, it is intended that the invention not be limited by any of the details disclosed, unless otherwise specified, but rather be construed broadly within its spirit and scope as set out in the accompanying claims.

What is claimed is:

1. A reel assembly for a slot machine which is adapted to be fixed on the drive shaft of an electric motor and has symbols disposed on the periphery thereof, comprising:

a cylindrical body having said symbols on the periphery thereof; and means for releasably securing said cylindrical body to a said drive shaft of an electric motor;

said cylindrical body comprising two frames of ring shape, at least one of said frames having a plurality of hollow sleeves extending toward but terminating a substantial distance from the other said frame, and a plurality of connecting members secured to said other frame and extending toward said one frame and being secured to said sleeves.

2. A reel assembly according to claim 1, there being said sleeves on both said frames, both ends of said connecting members being secured to said sleeves.

3. A reel assembly according to claim 2, said sleeves having a length substantially less than half the distance between said frames.

4. A reel assembly for a slot machine which is adapted to be fixed on the drive shaft of an electric motor and has symbols disposed on the periphery thereof, comprising:

a cylindrical body;

means for releasably securing said cylindrical body to a said drive shaft of an electric motor;

said cylindrical body comprising two frames of ring shape;

each said frame having a plurality of tongues thereon extending toward the other frame but terminating substantially less than half the distance toward said other frame; and a belt-like sheet disposed about the periphery of said two frames and adhesively secured to outer surfaces of said tongues and having said symbols thereon.

5. A reel assembly for a slot machine which is adapted to be fixed on the drive shaft of an electric motor and has symbols disposed on the outer periphery thereof, comprising:

a cylindrical body having said symbols on the periphery thereof; said cylindrical body comprising:

two frames of ring shape lying in two spaced parallel planes;

a plurality of arms extending radially and diagonally inwardly from one of said frames and secured at their inner ends to a central bridge plate parallel to said rings and spaced between said two planes; and means for releasably securing said bridge plate to a said drive shaft of an electric motor.

6. A reel assembly according to claim 5, wherein said one frame and said arms and said bridge plate are of one-piece molded plastic construction.

7. A reel assembly according to claim 6, said securing means comprising a metal plate secured flat against said plastic bridge plate by fasteners passing through said metal plate and bridge plate, said metal plate having an axially extending tubular portion adapted releasably to receive a said drive shaft.

8. A reel assembly according to claim 7, said tubular portion of said metal plate extending through a central hole in said plastic bridge plate.

9. A reel assembly for a slot machine which is adapted to be fixed on the drive shaft of an electric motor and has symbols disposed on the outer periphery thereof, comprising:

a cylindrical body having said symbols on the periphery thereof; said cylindrical body comprising:

two frames of ring shape;

a plurality of arms extending radially inwardly from one of said frames and secured at their inner ends to a central bridge plate; and means for releasably securing said bridge plate to a said drive shaft of an electric motor;

said one frame and said arms and said bridge plate being of one-piece molded plastic construction;

said securing means comprising a metal plate secured flat against said plastic bridge plate by fasteners passing through said metal plate and bridge plate, said metal plate having an axially extending tubular portion adapted releasably to receive a said drive shaft.

10. A reel assembly according to claim 9, said tubular portion of said metal plate extending through a central hole in said plastic bridge plate.

* * * * *